US011670145B1

(12) United States Patent
Ball et al.

(10) Patent No.: US 11,670,145 B1
(45) Date of Patent: Jun. 6, 2023

(54) EXIT ROUTE INDICATION VIA SYNCHRONIZED AUDIBLE CUES

(71) Applicant: Honeywell International Inc., Charlotte, NC (US)

(72) Inventors: Stuart Bryan Ball, Ibstock (GB); Gavin Davidson, Madrid (ES); Syed Naeem Ahmad, Wigston (GB); James Junior Nkhata, Leicester (GB); Sanjana Sethiya, Coventry (GB); Arjun Poovathingal Radhakrishnan, Leicester (GB); Ranjay Kumar, Leicester (GB)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/696,811

(22) Filed: Mar. 16, 2022

(51) Int. Cl.
*G08B 7/06* (2006.01)
*G08B 3/10* (2006.01)

(52) U.S. Cl.
CPC ..... *G08B 7/066* (2013.01); *G08B 3/10* (2013.01); *G08B 7/062* (2013.01)

(58) Field of Classification Search
CPC ..... G08B 7/066; G08B 3/10; G08B 7/062
See application file for complete search history.

(56) References Cited

U.S. PATENT DOCUMENTS 7,629,894 B2 12/2009 Plocher et al.
2009/0237242 A1* 9/2009 Karim ..... G08B 7/066 340/540
2012/0286932 A1* 11/2012 Lewis ..... G08B 7/066 340/6.1
2021/0183217 A1* 6/2021 Tran ..... G08B 7/062
2021/0248883 A1 8/2021 Ellis

FOREIGN PATENT DOCUMENTS

AU 2021200002 A1 7/2021
EP 1864693 A2 12/2007
KR 1618605 B1 5/2016

OTHER PUBLICATIONS

Exit Point™ Directional Sounder with Voice Messaging, System Sensor®, 2 pages, 2013.

* cited by examiner

*Primary Examiner* — Fekadeselassie Girma
*Assistant Examiner* — Rajsheed O Black-Childress
(74) *Attorney, Agent, or Firm* — Seager, Tufte & Wickhem, LLP

(57) ABSTRACT

Guiding people toward an exit of a facility includes sending messages to a plurality of sounder devices, each message addressed to a corresponding one of the sounder devices and including a payload that specifies one or more timing parameters unique to the corresponding sounder device, the one or more timing parameters specifying when an audible alarm is to be emitted by the corresponding sounder device. A broadcast alarm message is sent to all sounder devices. In response to receiving the broadcast alarm message, each of the sounder devices emit an audible alarm in accordance with the one or more timing parameters unique to the corresponding sounder device relative to a time of reception of the broadcast alarm message to produce the perceivable sequential audible sweep from the sounder devices toward the exit of the facility.

20 Claims, 11 Drawing Sheets

EXIT ROUTE INDICATION VIA SYNCHRONIZED AUDIBLE CUES

TECHNICAL FIELD

The present disclosure pertains generally to systems and methods for assisting people in evacuating a facility.

BACKGROUND

Many buildings and other facilities have audible alarms that are activated when an emergency situation occurs. The audible alarms alert people to evacuate the building or facility. Emergency situations can include, for example, a fire, a chemical spill, a bomb threat, an active shooter or any other emergency situation. In many cases, buildings have designated routes for exiting the building in the case of a fire or other emergency. These designated routes may be marked via signage. Unfortunately, in many cases, it can be difficult to read the signage in cases of limited visibility, such as when smoke from a fire enters an area of the building. Also, people often do not follow the signage, particular when under duress during an emergency situation. A need remains for improved systems and methods for guiding people out of an emergency situation using auditory cues.

SUMMARY

The present disclosure pertains generally to systems and methods for assisting people in evacuating a facility. An example may be found in a method for activating a plurality of sounder devices to produce a perceivable sequential audible sweep toward an exit of a facility. The illustrative method includes sending via a communication bus a plurality of messages to the plurality of sounder devices, each message addressed to a corresponding one of the plurality of sounder devices and each message including a payload that specifies one or more timing parameters unique to the corresponding sounder device. The one or more timing parameters specify when an audible alarm is to be emitted by the corresponding sounder device, such as relative to a subsequent broadcast alarm message. A broadcast alarm message is subsequently sent via the communication bus to all of the plurality of sounder devices. In response to receiving the broadcast alarm message, each of the plurality of sounder devices emit an audible alarm in accordance with the one or more timing parameters unique to the corresponding sounder device relative to a time of reception of the broadcast alarm message to produce a perceivable sequential audible sweep from the plurality of sounder devices toward the exit of the facility.

Another example may be found in a method for providing an indication of an exit route. The exit route includes a plurality of devices networked to an alarm panel, each of the plurality of devices including an internal clock and being configured to provide an audible alarm. The illustrative method includes the alarm panel sending to each of the plurality of devices that are networked to the alarm panel a specific position within an alarm sequence that specifies an order in which the plurality of devices are to each output their audible alarm. The alarm panel broadcasts an alarm signal to each of the plurality of devices that are networked to the alarm panel. In response to receiving the alarm signal from the alarm panel, each of the plurality of devices emit an audible alarm in accordance with their specific position within the alarm sequence that specifies the order in which the plurality of devices are to each output their audible alarm.

Another example may be found in a system that includes a plurality of sounder devices for emitting an audible alarm and an alarm panel that is operably coupled to the plurality of sounder devices. The alarm panel is configured to send to each of the plurality of sounder devices a specific position within an alarm sequence that specifies an order in which the plurality of sounder devices are to each output their audible alarm. The alarm panel is further configured to broadcast to each of the plurality of sounder devices an alarm signal. In response to receiving the alarm signal, each of the plurality of sounder devices emit an audible alarm in accordance with their specific position within the alarm sequence.

The preceding summary is provided to facilitate an understanding of some of the features of the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments of the disclosure in connection with the accompanying drawings, in which.

Figure 1:
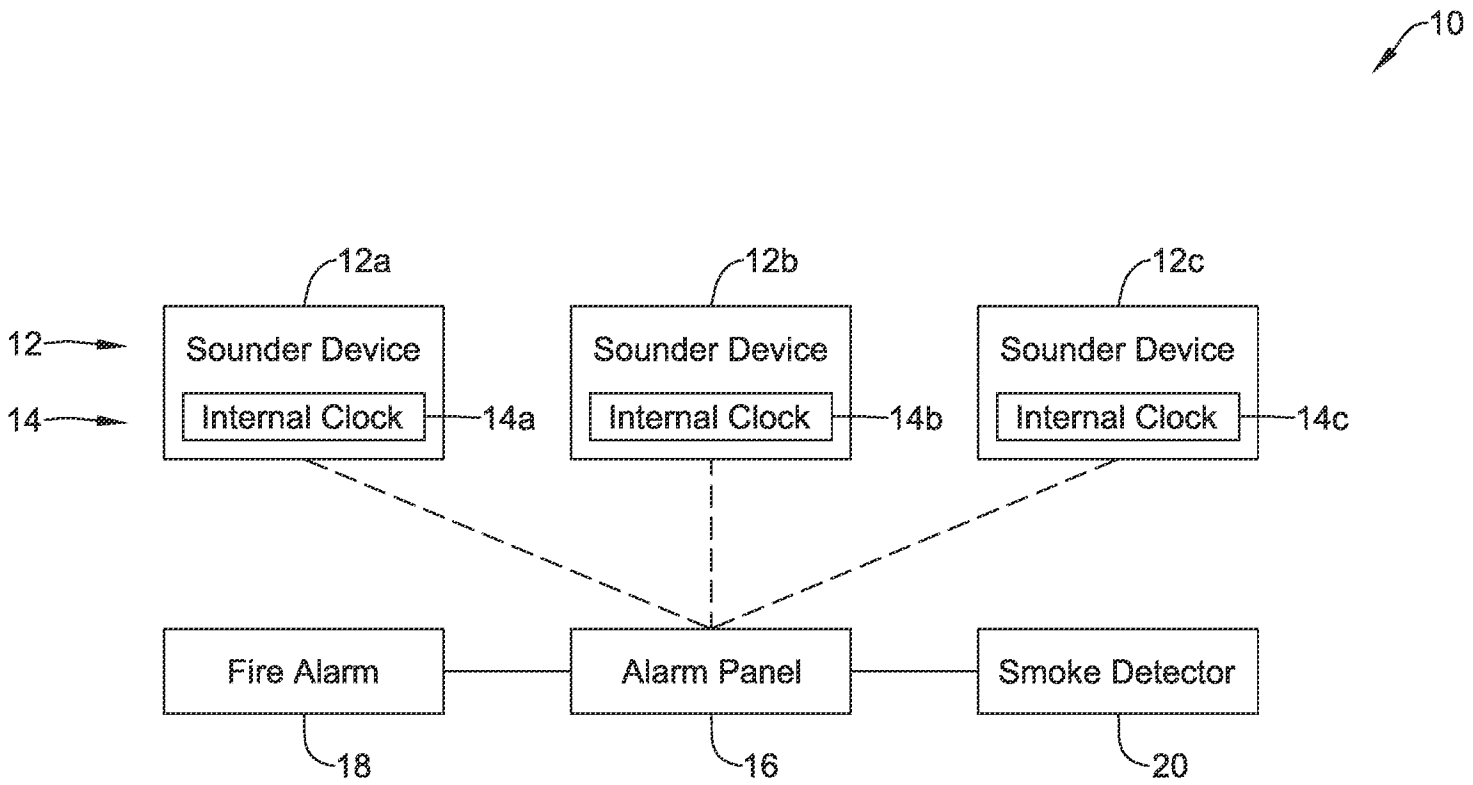
FIG. 1 is a schematic block diagram of an illustrative system.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about", unless the content clearly dictates otherwise. The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

FIG. 1 is a schematic block diagram of an illustrative system 10 that is configured to guide people through an exit route to an exit of a facility, particularly in situations with reduced visibility in which it may be difficult to see an EXIT sign for example, or in a stressful situation in which it may be difficult to remember a long-ago learned exit route. The illustrative system 10 includes a plurality of sounder devices 12, individually labeled as 12*a*, 12*b*, and 12*c*. While a total of three sounder devices 12 are shown, it will be appreciated that this is merely illustrative, as the system 10 may include any number of sounder devices 12, and may include substantially more than three sounder devices 12. The sounder devices 12 may be distributed throughout a facility, such as one sounder device 12 per area, room or space within each floor of the facility. Each of the sounder devices 12 are configured to emit an audible alarm.

In some cases, at least some of the sounder devices 12 may be stand-alone, single-function devices that are designed simply to sound an alarm, for example, or to emit audible alarms. In some cases, at least some of the sounder devices 12 are multiple function devices, such as fire alarms, smoke detectors, EXIT signs, fire and/or emergency lighting devices, and others, that are configured not only to perform their primary function but to also emit audible alarms. Each of the sounder devices 12 include an internal clock 14, individually labeled as 14*a*, 14*b* and 14*c*. The internal clock 14 within a particular sounding device 12 may be used by the sounder device 12 to know when to emit an audible alarm or other noise according to a sequence (e.g. sweep) that can help to guide a person through a poor visibility situation to safely reach an exit.

The illustrative system 10 includes an alarm panel 16 that is operatively coupled to the plurality of sounder devices 12. The alarm panel 16 is configured to send to each of the plurality of sounder devices 12 a specific position within an alarm sequence that specifies an order in which the plurality of sounder devices 12 are to each output their audible alarm. The alarm panel 16 is also configured to broadcast to each of the plurality of sounder devices 12 an alarm signal that triggers the alarm sequence. The alarm sequence may be determined when the system 10 is installed, for example, and may be programmed into the alarm panel 16 and/or sounder devices 12. In some cases, the alarm sequence may be determined when an alarm is sounded and a determination is made as to whether a particular exit and/or route is safe to use, for example, or if one or more of the sounder devices 12 have stopped working. In response to receiving the alarm signal from the alarm panel 16, each of the plurality of sounder devices 12 are configured to emit an audible alarm in accordance with their specific position within the alarm sequence. In some instances, the plurality of sounder devices 12 each output their audible alarm such that a quiet period is provided between the specific position within the alarm sequence. While the quiet period may have any suitable duration, to increase the sense of perceived motion of the alarm sequence toward the exit, the quiet period may be 5 milliseconds or less, 4 milliseconds or less, 3 milliseconds or less, 2 milliseconds or less, or 1 milliseconds or less.

In some cases, the alarm panel 16 may be configured to broadcast to each of the plurality of sounder devices 12 a synchronization signal, wherein in response to receiving the synchronization signal, each of the plurality of sounder devices 12 synchronize their internal clocks 14 to the synchronization signal and thus to each other. Having synchronized clocks helps achieve synchronization between the audible alarms emitted by the plurality of sounder devices 12, as well as achieving a consistent and relatively short quiet period between the audible alarms, both of which are useful in producing the desired sense of perceived motion of the alarm sequence toward the exit. To maintain the reliability of the system, the alarm panel 16 may be configured to repeatedly poll each of the plurality of sounder devices 12 to verify that each of the plurality of sounder devices 12 remains online and active.

In some cases, as shown, the illustrative system 10 may include a fire alarm 18 that is operably coupled with the alarm panel 16 and/or a smoke detector 20 that is operably coupled with the alarm panel 16. While a single fire alarm 18 is shown, in some cases a facility may have two, three or more fire alarms 18 operably coupled to the alarm panel 16 so that the alarm panel 16 can instruct the one or more fire alarms 18 when there is an emergency such as a detected fire and when the one or more fire alarms 18 should sound an alarm. In some cases, there may be no separate fire alarm 18, and the sounder devices 12 may in combination serve as the fire alarm.

While a single smoke detector 20 is shown, a facility will likely have a large number of smoke detectors 20 that are operably coupled to the alarm panel 16. The smoke detector 20 may be configured to alert the alarm panel 16 to a possible fire, for example. The alarm panel 16 may also receive alerts regarding possible fires or other possible emergencies from other devices such as but not limited to a neighboring alarm panel, for example. While a fire alarm is used as an example in FIG. 1, it is contemplated that the present alarm system may be used in response to any suitable emergency situation such as, a fire, a chemical spill, a bomb threat, an active shooter or any other emergency situation. Moreover, it is contemplated that the facility may be a building, a collection of buildings such as a campus of buildings, a vehicle such as a ship or a plane, and/or any other suitable facility.

Figure 2:
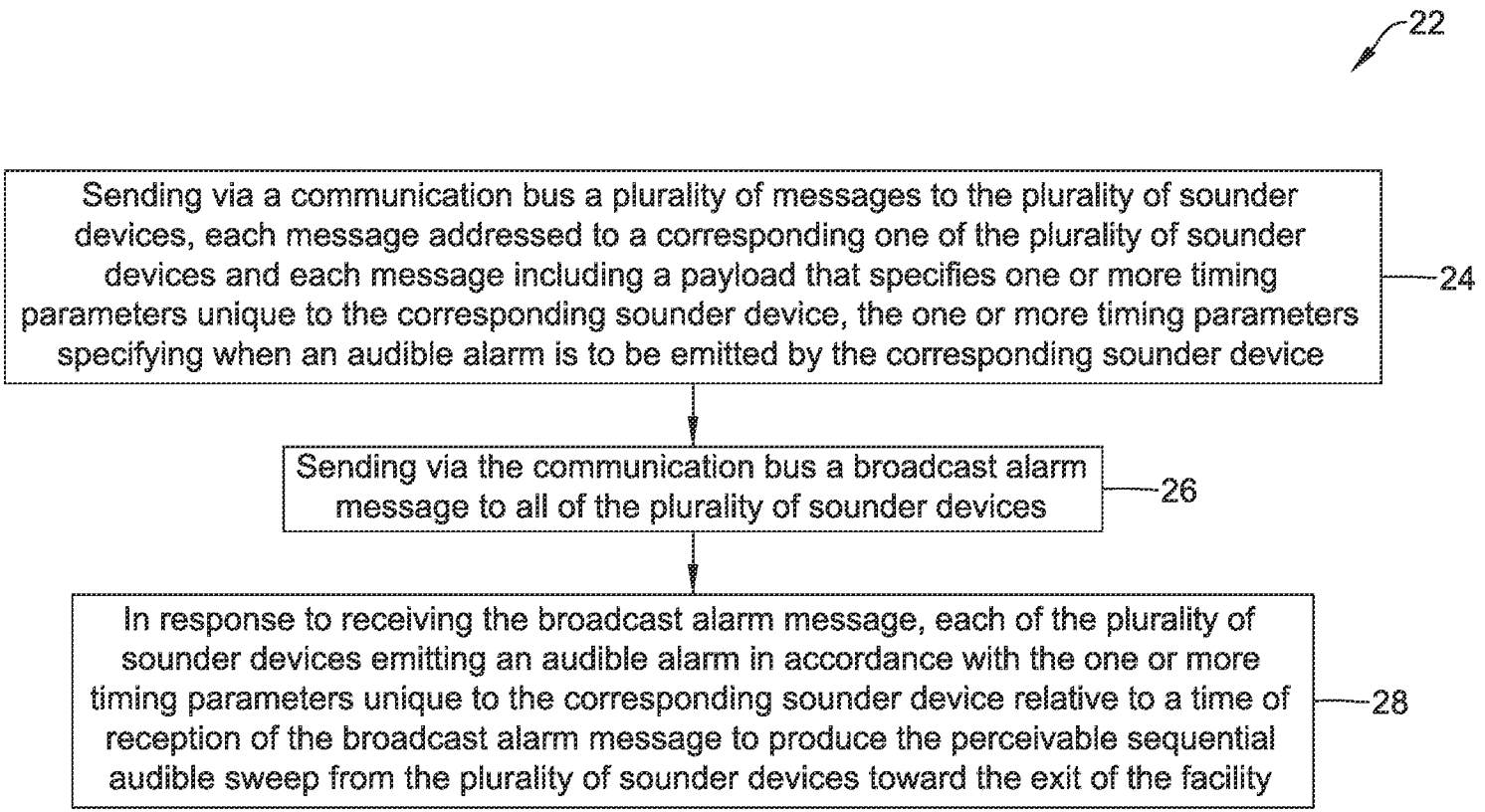
FIG. 2 is a flow diagram showing an illustrative method.

FIG. 2 is a flow diagram showing an illustrative method 22 for activating a plurality of sounder devices (such as the sounder devices 12) to produce a perceivable sequential audible sweep toward an exit of a facility. The illustrative method 22 includes sending via a communication bus a plurality of messages to the plurality of sounder devices, each message addressed to a corresponding one of the plurality of sounder devices and each message including a payload that specifies one or more timing parameters unique to the corresponding sounder device, as indicated at block 24. The one or more timing parameters specify when an audible alarm is to be emitted by the corresponding sounder device relative to a broadcast alarm message. A broadcast alarm message is sent to all of the plurality of sounder devices via the communication bus, as indicated at block 26.

In response to receiving the broadcast alarm message, each of the plurality of sounder devices emit an audible alarm in accordance with the one or more timing parameters unique to the corresponding sounder device relative to a time of reception of the broadcast alarm message to produce the perceivable sequential audible sweep from the plurality of sounder devices toward the exit of the facility, as indicated at block 28. In some cases, the alarm sequence may include one or more time slots where all of the plurality of sounder devices emit an audible alarm, followed by a plurality of time slots where each of the plurality of sounder devices emit an audible alarm in a designated one of time slots.

In some cases, the one or more timing parameters are configured to cause each of the plurality of sounder devices to emit an audible alarm in a corresponding one of a plurality of sequential time slots of an alarm sequence, with a quiet period between each of the audible alarms. The quiet period may, for example, be five milliseconds or less. In some cases, the one or more timing parameters may specify a corresponding one of the plurality of sequential time slots of the alarm sequence for the corresponding sounder device. In some cases, the one or more timing parameters may include one or more of a trigger interval that specifies how long after the time of reception of the broadcast alarm message that the audible alarm of the corresponding sounder device is to be emitted, and an alarm duration that specifies a duration of the corresponding audible alarm.

It is contemplated that the communication bus may be a wired or wireless communications bus. The communication bus may allow broadcast messages as well as messages addressed to specific devices or groups of devices on the communication bus. Example wired communication bus protocols includes Fieldbus, BACnet, LON, Modbus, C-Bus, and Ethernet. Example wireless communication bus protocols include WiFi, Zigbee, Z-wave, Bluetooth, and EnOcean. These are just examples.

Figure 3:
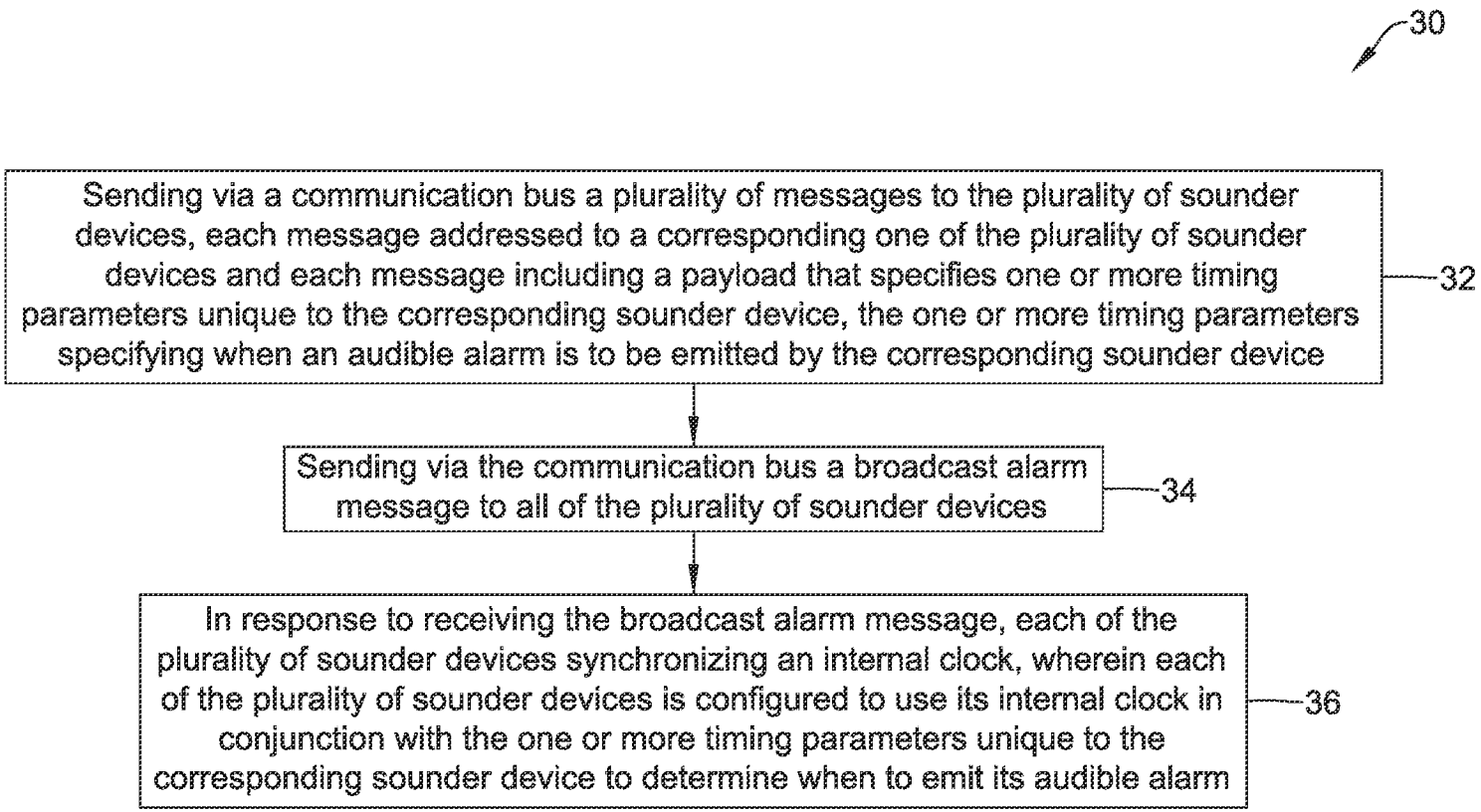
FIG. 3 is a flow diagram showing an illustrative method.

FIG. 3 is a flow diagram showing an illustrative method 30 for activating a plurality of sounder devices (such as the sounder devices 12) to produce a perceivable sequential audible sweep toward an exit of a facility. The illustrative method 30 includes sending via a communication bus a plurality of messages to the plurality of sounder devices, each message addressed to a corresponding one of the plurality of sounder devices and each message including a payload that specifies one or more timing parameters unique to the corresponding sounder device, as indicated at block 32. The one or more timing parameters specify when an audible alarm is to be emitted by the corresponding sounder device relative to a broadcast alarm message. A broadcast alarm message is sent to all of the plurality of sounder devices via the communication bus, as indicated at block 34.

In some cases, in response to receiving the broadcast alarm message, each of the plurality of sounder devices may synchronize their internal clock, wherein each of the plurality of sounder devices is configured to use its internal clock in conjunction with the one or more timing parameters unique to the corresponding sounder device to determine when to emit its audible alarm, as indicated at block 36. In some instances, each of the sounder devices emit an audible alarm in accordance with the one or more timing parameters unique to the corresponding sounder device relative to a time of reception of the broadcast alarm message to produce the perceivable sequential audible sweep from the plurality of sounder devices toward the exit of the facility.

Figure 4:
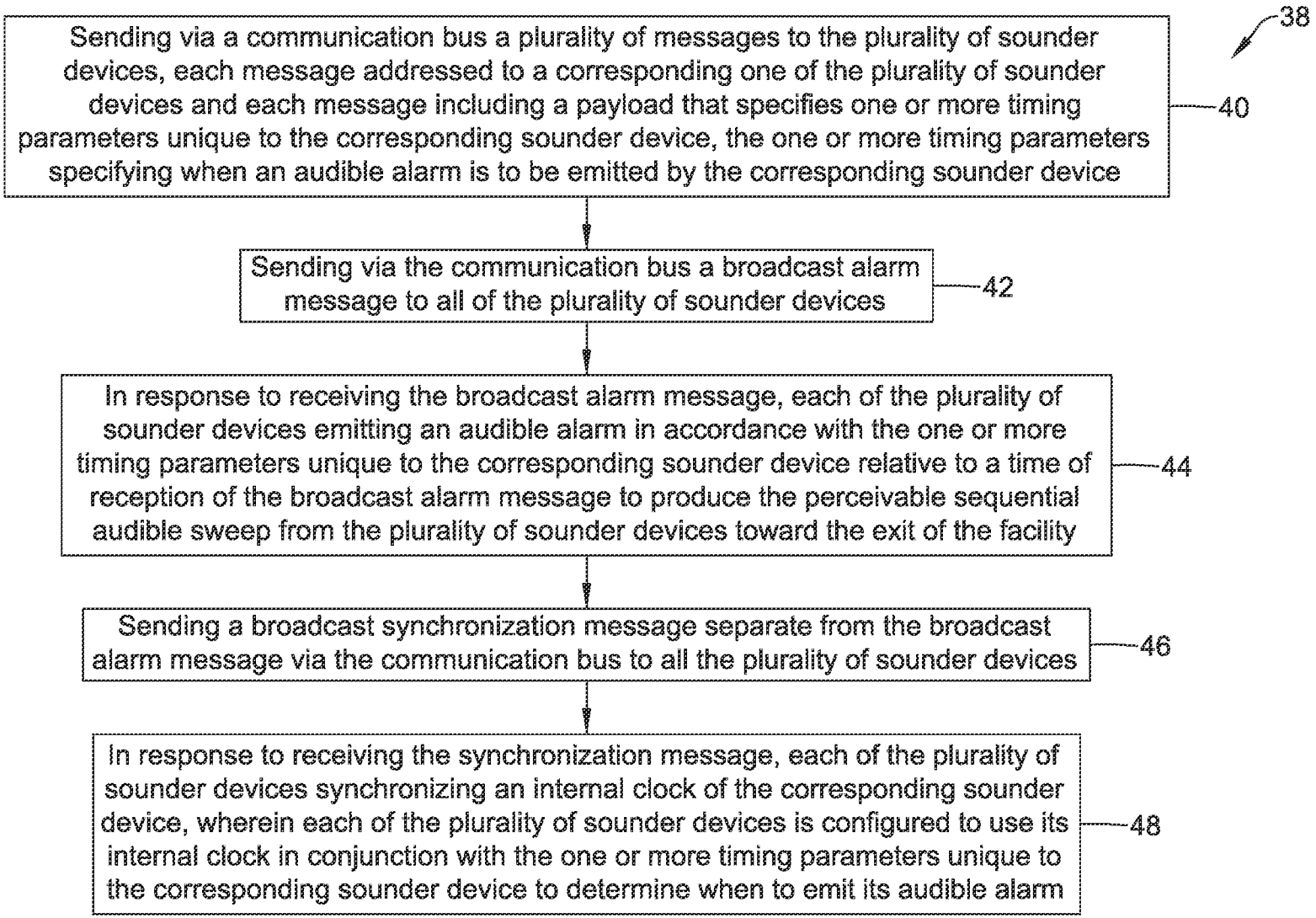
FIG. 4 is a flow diagram showing an illustrative method.

FIG. 4 is a flow diagram showing an illustrative method 38 for activating a plurality of sounder devices (such as the sounder devices 12) to produce a perceivable sequential audible sweep toward an exit of a facility. The illustrative method 38 includes sending via a communication bus a plurality of messages to the plurality of sounder devices, each message addressed to a corresponding one of the plurality of sounder devices and each message including a payload that specifies one or more timing parameters unique to the corresponding sounder device, as indicated at block 40. The one or more timing parameters specify when an audible alarm is to be emitted by the corresponding sounder device.

A broadcast alarm message is sent to all of the plurality of sounder devices via the communication bus, as indicated at block 42. In response to receiving the broadcast alarm message, each of the plurality of sounder devices emit an audible alarm in accordance with the one or more timing parameters unique to the corresponding sounder device relative to a time of reception of the broadcast alarm message to produce the perceivable sequential audible sweep from the plurality of sounder devices toward the exit of the facility, as indicated at block 44.

In some cases, a broadcast synchronization message, which is separate from the broadcast alarm message, is sent via the communication bus to all of the plurality of sounder devices, as indicated at block 46. This may be done periodically, such as every 60 seconds, every 1 hour, every day or every month. In response to receiving the broadcast synchronization message, each of the plurality of sounder devices synchronize their internal clock, wherein each of the plurality of sounder devices is configured to use its internal clock in conjunction with the one or more timing parameters unique to the corresponding sounder device to determine when to emit its audible alarm, as indicated at block 48.

Figure 5:
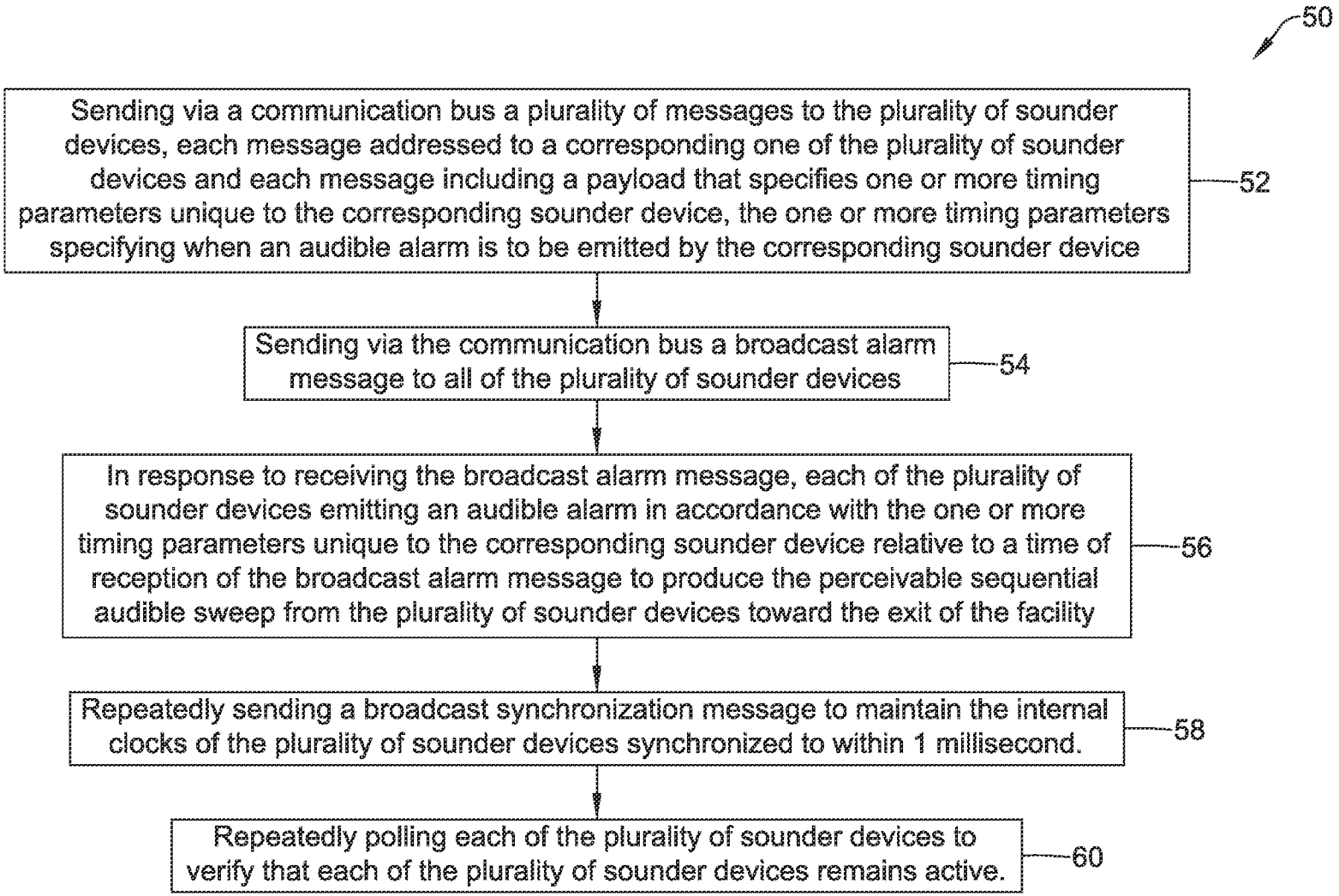
FIG. 5 is a flow diagram showing an illustrative method.

FIG. 5 is a flow diagram showing an illustrative method 50 for activating a plurality of sounder devices (such as the sounder devices 12) to produce a perceivable sequential audible sweep toward an exit of a facility. The illustrative method 50 includes sending via a communication bus a plurality of messages to the plurality of sounder devices, each message addressed to a corresponding one of the plurality of sounder devices and each message including a payload that specifies one or more timing parameters unique to the corresponding sounder device, as indicated at block 52. The one or more timing parameters specify when an audible alarm is to be emitted by the corresponding sounder device. A broadcast alarm message is sent to all of the plurality of sounder devices via the communication bus, as indicated at block 54.

In response to receiving the broadcast alarm message, each of the plurality of sounder devices emit an audible alarm in accordance with the one or more timing parameters unique to the corresponding sounder device relative to a time of reception of the broadcast alarm message to produce the perceivable sequential audible sweep from the plurality of sounder devices toward the exit of the facility, as indicated at block 56.

In some cases, the method 50 may include repeatedly sending a broadcast synchronization message in order to maintain the internal clocks of each of the sounder devices synchronized to within 1 millisecond or less, as indicated at block 58. In some cases, and to maintain the reliability of the system, the method 50 may include repeatedly polling each of the plurality of sounder devices to verify that each of the plurality of sounder devices remains online and active, as indicated at block 60.

Figure 6:
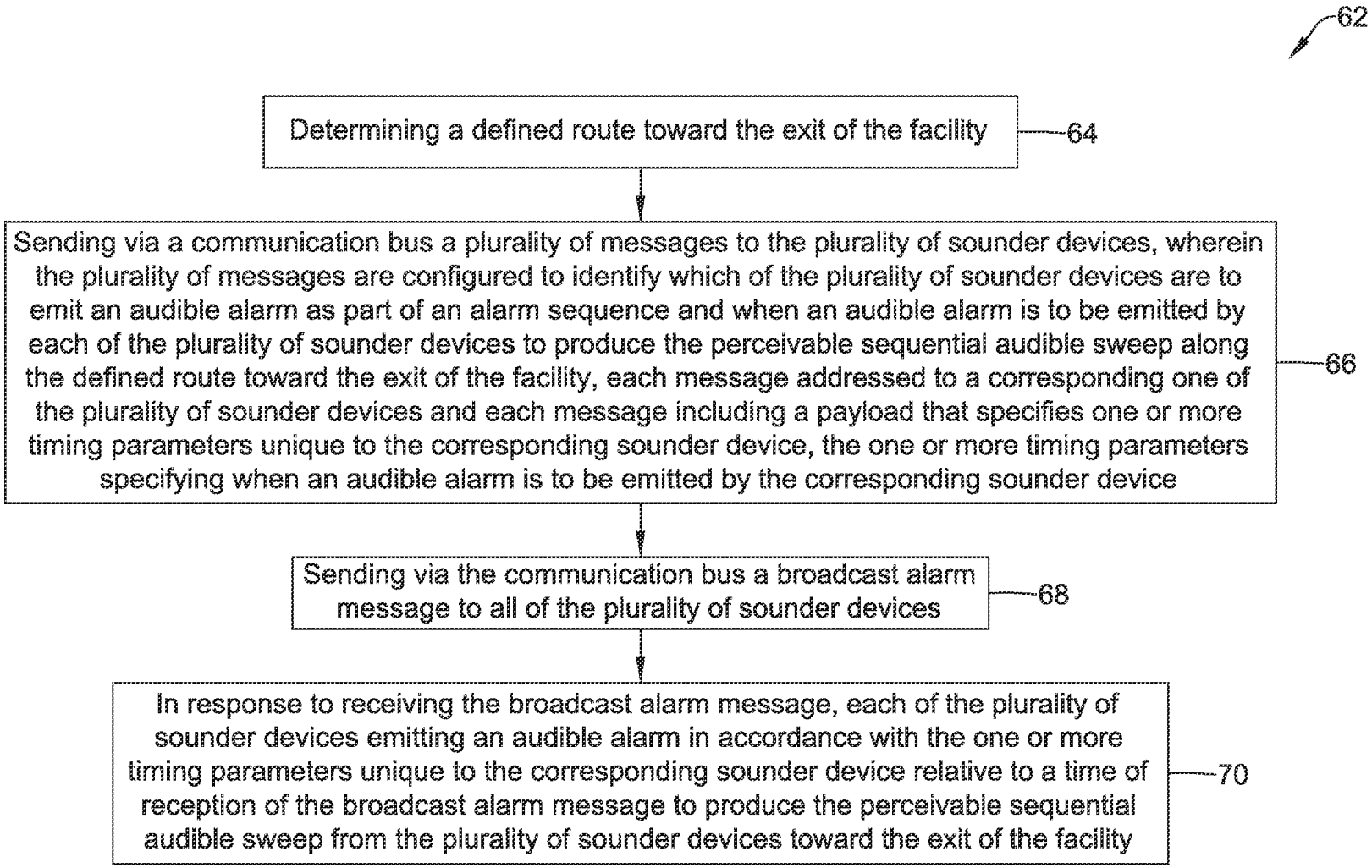
FIG. 6 is a flow diagram showing an illustrative method.

FIG. 6 is a flow diagram showing an illustrative method 62 for activating a plurality of sounder devices (such as the sounder devices 12) to produce a perceivable sequential audible sweep toward an exit of a facility. The illustrative method 62 includes determining a defined route towards an exit of the facility, as indicated at block 64. In some cases, the route may be determined based on information regarding which routes and/or exits of the facility may current be blocked or otherwise unadvised based on the current emergency situation, such as blocked by a fire, a chemical spill or the like. In some cases, the route may also take into account any sounder devices that are not currently functional.

Once the route is determined, the illustrative method 62 includes sending via a communication bus a plurality of messages to the plurality of sounder devices, wherein the plurality of messages are configured to identify which of the plurality of sounder devices are to emit an audible alarm as part of an alarm sequence and when an audible alarm is to be emitted by each of the plurality of sounder devices to produce the perceivable sequential audible sweep along the defined route toward the exit of the facility, as indicated at block 66. Each message is addressed to a corresponding one of the plurality of sounder devices and each message including a payload that specifies one or more timing parameters unique to the corresponding sounder device. The one or more timing parameters specify when an audible alarm is to be emitted by the corresponding sounder device. Thereafter, a broadcast alarm message is sent to all of the plurality of sounder devices via the communication bus, as indicated at block 68.

In response to receiving the broadcast alarm message, each of the plurality of sounder devices emit an audible alarm in accordance with the one or more timing parameters unique to the corresponding sounder device relative to a time of reception of the broadcast alarm message to produce the perceivable sequential audible sweep from the plurality of sounder devices along the defined route and toward the exit of the facility, as indicated at block 70.

Figure 7:
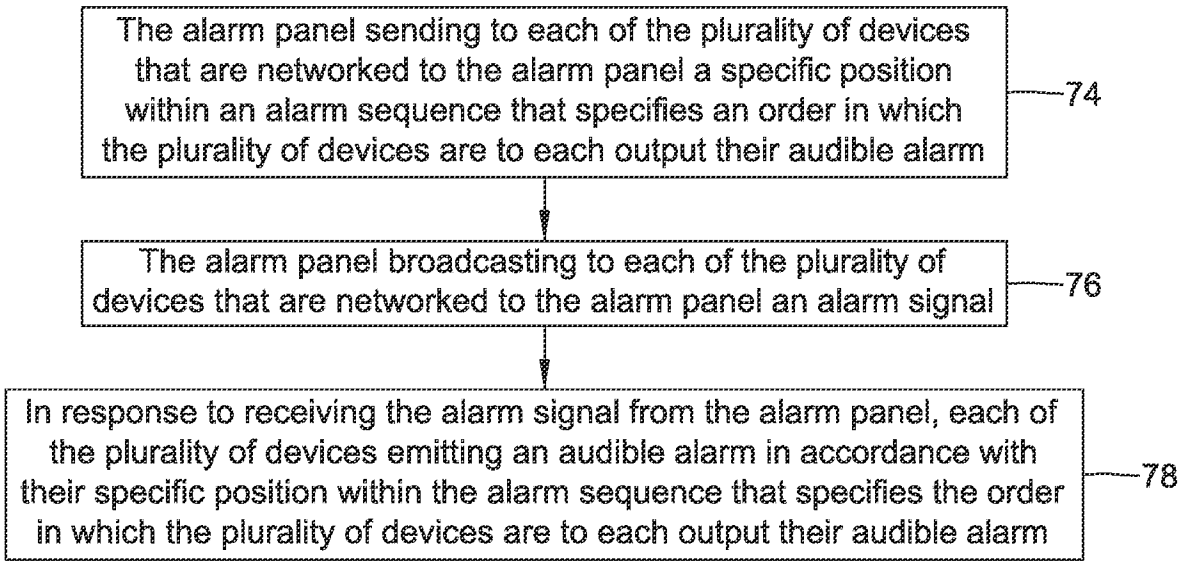
FIG. 7 is a flow diagram showing an illustrative method.

FIG. 7 is a flow diagram showing an illustrative method 72 for providing an indication of an exit route, the exit route including a plurality of devices (such as the sounder devices 12) networked to an alarm panel (such as the alarm panel 16). Each of the plurality of devices includes an internal clock (such as the internal clocks 14) and is configured to provide an audible alarm. The illustrative method 72 includes the alarm panel sending to each of the plurality of devices that are networked to the alarm panel a specific position within an alarm sequence that specifies an order in which the plurality of devices are to each output their audible alarm, as indicated at block 74. Then, the alarm panel broadcasts an alarm signal to each of the plurality of devices that are networked to the alarm panel, as indicated at block 76. In response to receiving the alarm signal from the alarm panel, each of the plurality of devices emit an audible alarm in accordance with their specific position within the alarm sequence that specifies the order in which the plurality of devices are to each output their audible alarm, as indicated at block 78.

In some cases, the alarm panel may broadcast a separate synchronization signal, either instead of or in addition to broadcasting the alarm signal, and in response to the synchronization signal, each of the plurality of devices may synchronize their internal clocks. In some cases, the plurality of devices each output their audible alarm such that a quiet period is provided between the specific position within the alarm sequence. As an example, the quiet period may be 2 milliseconds or less.

Figure 8:
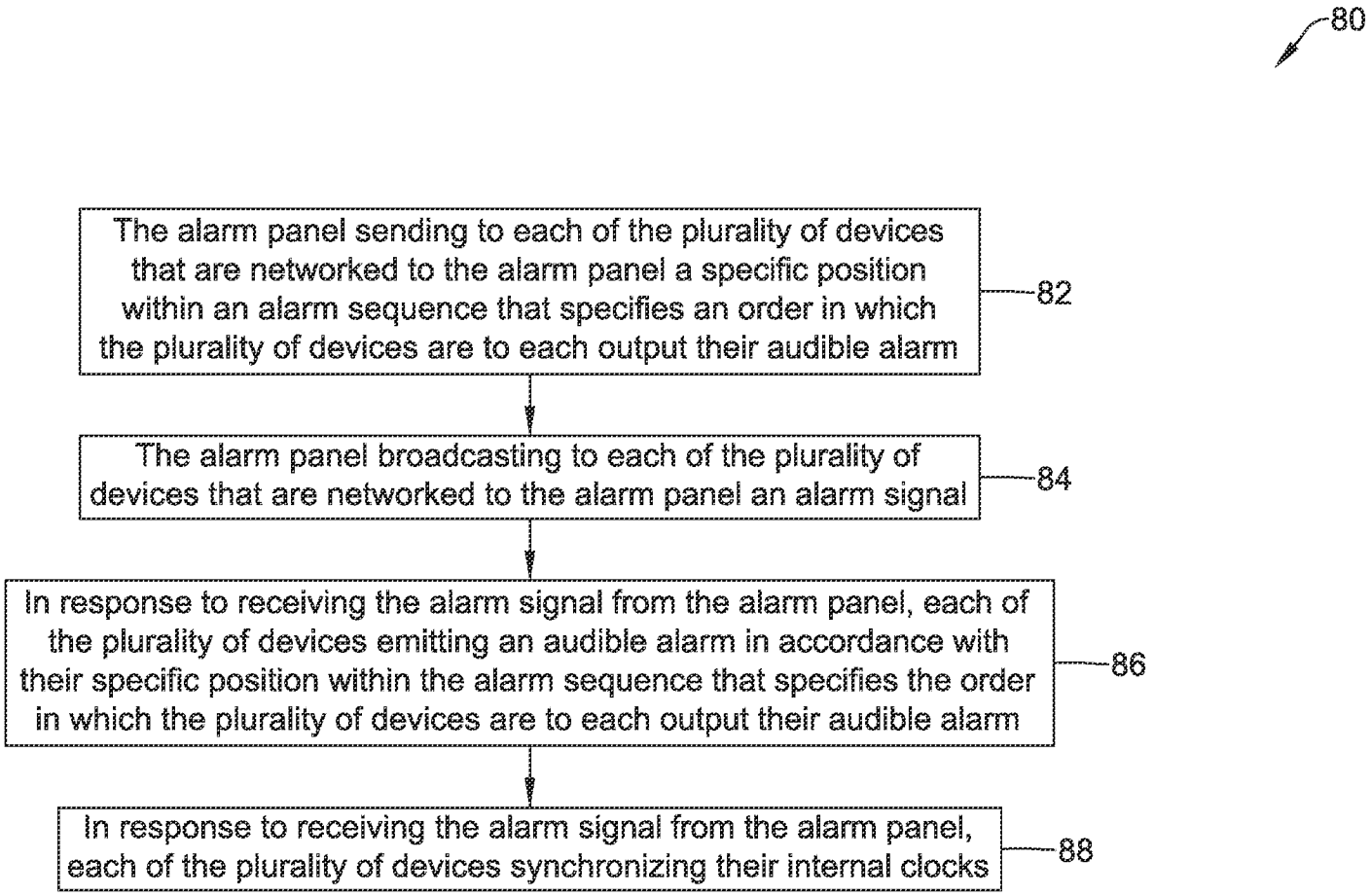
FIG. 8 is a flow diagram showing an illustrative method.

FIG. 8 is a flow diagram showing an illustrative method 80 for providing an indication of an exit route, the exit route including a plurality of devices (such as the sounder devices 12) networked to an alarm panel (such as the alarm panel 16). Each of the plurality of devices includes an internal clock (such as the internal clocks 14) and is configured to provide an audible alarm. The method 80 includes the alarm panel sending to each of the plurality of devices that are networked to the alarm panel a specific position within an alarm sequence that specifies an order in which the plurality of devices are to each output their audible alarm, as indicated at block 82.

Subsequently, the alarm panel broadcasts an alarm signal to each of the plurality of devices that are networked to the alarm panel, as indicated at block 84. In response to receiving the alarm signal from the alarm panel, each of the plurality of devices emit an audible alarm in accordance with their specific position within the alarm sequence that specifies the order in which the plurality of devices are to each output their audible alarm, as indicated at block 86. In some cases, the method 80 may further include, in response to receiving the alarm signal from the alarm panel, each of the plurality of devices synchronizing their internal clocks, as indicated at block 88.

Figure 9:
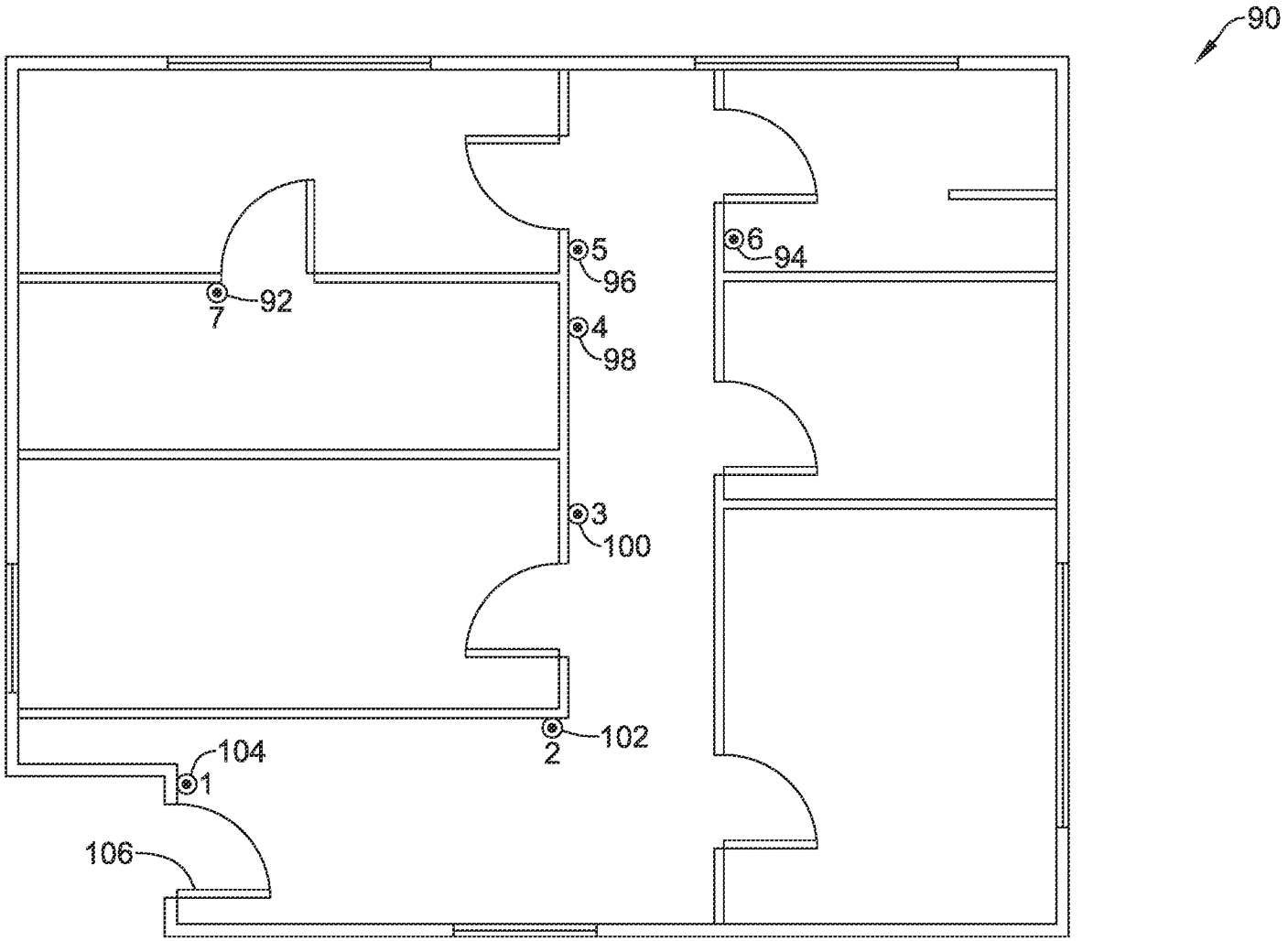
FIG. 9 is a schematic view of a floor plan providing an example of how sounding devices are used to provide an exit route.

FIG. 9 is a schematic view of a floor plan 90 providing an example of how sounding devices are used to provide an exit route. A number of sounding devices, individually labeled as 92, 94, 96, 98, 100, 102 and 104 are dispersed within the floor plan 90. The floor plan 90 includes an exit 106. It will be appreciated that the sounding device 92 is farthest from the exit 106 while the sounding device 104 is closest to the exit 106.

When an alarm has sounded, the sounding devices 92, 94, 96, 98, 100, 102 and 104 sequentially emit an audible alarm, one at a time, in order to guide people present within the space represented by the floor plan 90 toward the exit 106 and to safety. In an example alarm sequence, the sounding device 92 first emits an audible alarm. Next, the sounding device 94 emits an audible alarm. Next, the sounding device 96 emits an audible alarm. Next, the sounding device 98 emits an audible alarm. Next, the sounding device 100 emits an audible alarm. Next, the sounding device 102 emits an audible alarm. Next, the sounding device 104 emits an audible alarm. By virtue of each of the sounding devices 92, 94, 96, 98, 100, 102 and 104 sequentially emitting audible chirps, each for a short period of time with a brief quiet period between sequential audible chirps, a person is able to get a sense of perceived motion of the alarm sequence toward the exit 106, which may allow people to more easily follow the sound as it guides them towards the exit 106, even when visibility is restricted by for example smoke or darkness.

Figure 10:
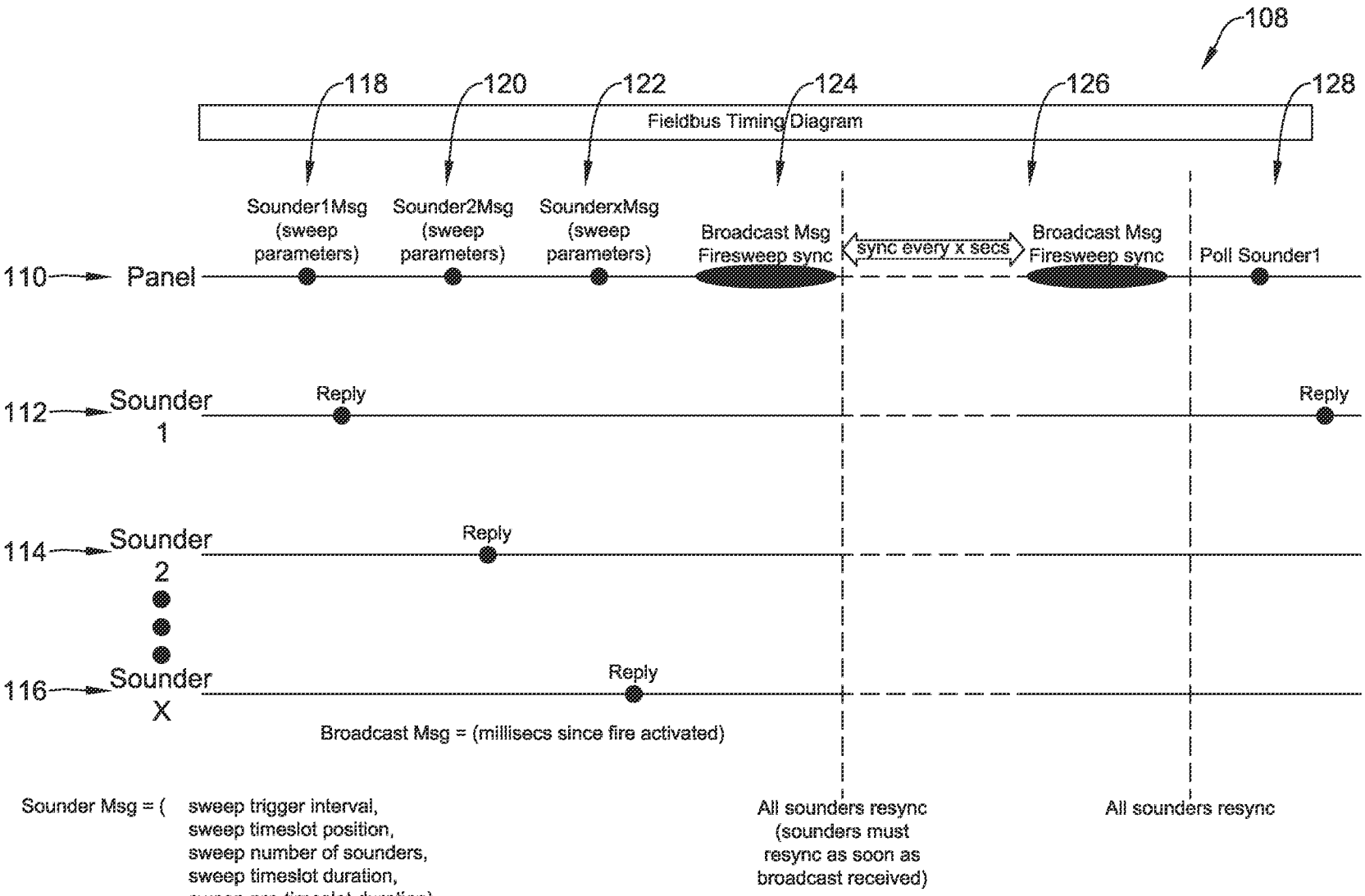
FIG. 10 is an illustrative timing diagram.

FIG. 10 is a timing diagram 108 that showing illustrative communication between the alarm panel 16 and the individual sounding devices 12. The timing diagram 108 includes a row 110 that indicates activity by the alarm panel 16. The timing diagram 108 includes a row 112 that indicates activity by a first sounder device 12, a row 114 that indicates activity by a second sounder device 12, through a row 116 that indicates activity by an "$x^{th}$" sounding device 12, where "x" is an integer greater than 2.

As indicated in a first column 118, the alarm panel 16 provides a message to the first sounder device 12. This message includes timing information such as but not limited to a sweep trigger interval, a timeslot position, a number of sounders in the alarm sequence, a timeslot duration and/or a pre-timeslot duration. The first sounder device 12 replies a short time later, indicating that the message was received. As indicated in a second column 120, the alarm panel 16 provides a message to the second sounder device 12. This message includes timing information such as but not limited to a sweep trigger interval, a timeslot position, a number of sounders, a timeslot duration and/or a pre-timeslot duration. The second sounder device 12 replies a short time later, indicating that the message was received. As indicated in a third column 122, the alarm panel 16 provides a message to the "$x^{th}$" sounder device 12. This message includes timing information such as but not limited to a sweep trigger interval, a timeslot position, a number of sounders, a timeslot duration and/or a pre-timeslot duration. The "$x^{th}$" sounder device 12 replies a short time later, indicating that the message was received.

A column 124 indicates that the alarm panel 16 provides a broadcast message to all of the sounder devices 12. The broadcast message serves as a synchronization signal that all of the sounder devices 12 receive and can use to synchronize their internal clocks so that each of the sounder devices 12 can accurately participate in a sound sweep in order to guide one or more people safely to the exit 106. As indicated in a column 126, the broadcast message is periodically repeated. In some cases, the broadcast message may be a broadcast alarm message that also initiates activation of the alarm sequence. In other cases, the broadcast alarm message may be separately provided from the broadcast message.

As indicated in a column 128, the alarm panel 16 may periodically poll each of the sounder devices 12, to ensure that each of the sounder devices 12 are still online and operational. For example, a sounder device 12 may become disabled if its battery power drops below a useful level. A sounder device 12 could be disabled by fire, for example. By periodically polling each of the sounder devices 12, the alarm panel 16 knows which sounder devices 12 are available to participate in a sound sweep if one becomes necessary.

Figure 11:
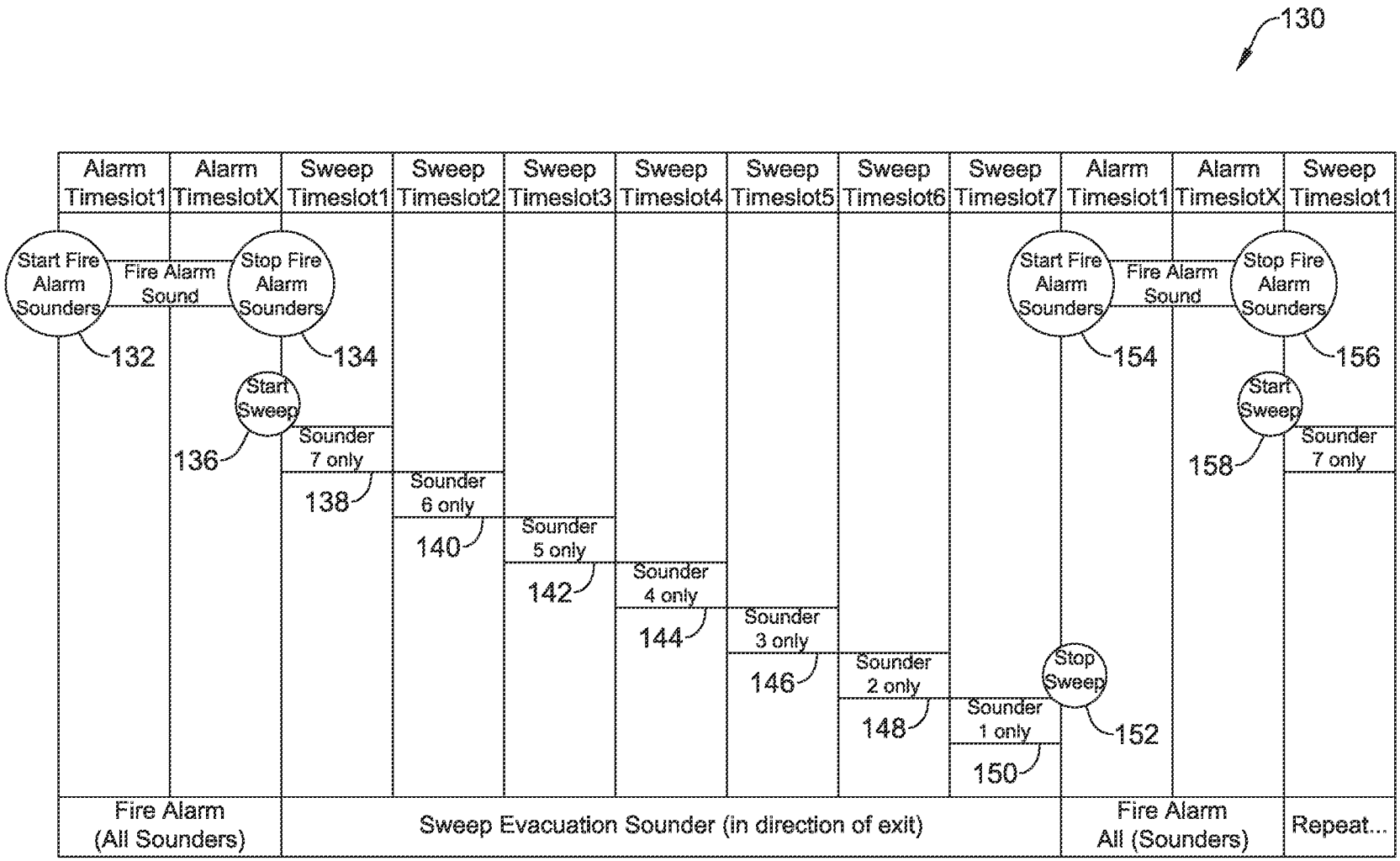
FIG. 11 is an illustrative timing diagram.

FIG. 11 is a timing diagram 130 that shows an example of a fire alarm sequence. In this example, there are a total of seven (7) sounder devices 12, matching what is shown in FIG. 9. The fire alarm sequence is initiated at a starting time 132. The fire alarm sequence starts with a collective alarm period (here two time slots) where all sounder devices 12 emit a corresponding audible alarm. The collective alarm period continues until stopping time 134. Then, a sound sweep sequence starts at a starting time 136, which may correspond to the stopping time 134, or may be slightly before or after the stopping time 134. In some cases, a quiet period may be provided between the stopping time 134 and when the sound sweep sequence begins.

During the sound sweep sequence, sounder 7 first sounds its audible alarm during time slot 138. Sounder 6 then sounds its audible alarm during time slot 140 that starts a short quiet time after the time slot 138 ends. Sounder 5 then sounds its audible alarm during time slot 142 that starts a short quiet time after the time slot 140 ends. Sounder 4 then sounds its audible alarm during time slot 144 that starts a short time after the time slot 142 ends. Sounder 3 then sounds its audible alarm during time slot 146 that starts a short time after the time slot 144 ends. Sounder 2 then sounds its audible alarm during time slot 148 that starts a short time after the time slot 146 ends. Finally, sounder 1 then sounds its audible alarm during time slot 150 that starts a short time after the time slot 148 ends. In some instances, each of the time slots 138, 140, 142, 144, 146 and 148 are equal or at least substantially equal in duration. The sound sweep sequence ends at time 152. Just before or after the end of the sound sweep sequence, another collective alarm period (here two time slots) is performed, starting at time 154 and ending at time 156, where all sounder devices 12 emit a corresponding audible alarm. Thereafter, a new sound sweep sequence begins at a starting point 158, which may be just before or just after the stopping time 156, and continues as before. This alarm sequence may be repeated until the emergency situation is resolved.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A method for activating a plurality of sounder devices to produce a perceivable sequential audible sweep toward an exit of a facility, the method comprising:

sending via a communication bus a plurality of messages to the plurality of sounder devices, each message addressed to a corresponding one of the plurality of sounder devices and each message including a payload that specifies one or more timing parameters unique to the corresponding sounder device, the one or more timing parameters specifying when an audible alarm is to be emitted by the corresponding sounder device;

sending via the communication bus a broadcast alarm message to all of the plurality of sounder devices; and in response to receiving the broadcast alarm message, each of the plurality of sounder devices emitting an audible alarm in accordance with the one or more timing parameters unique to the corresponding sounder device relative to a time of reception of the broadcast alarm message to produce the perceivable sequential audible sweep from the plurality of sounder devices toward the exit of the facility.

2. The method of claim 1, wherein in response to receiving the broadcast alarm message, each of the plurality of sounder devices synchronizing an internal clock, wherein each of the plurality of sounder devices is configured to use its internal clock in conjunction with the one or more timing parameters unique to the corresponding sounder device to determine when to emit its audible alarm.

3. The method of claim 1 further comprising:

sending a broadcast synchronization message separate from the broadcast alarm message via the communication bus to all of the plurality of sounder devices; and in response to receiving the broadcast synchronization message, each of the plurality of sounder devices synchronizing an internal clock of the corresponding sounder device, wherein each of the plurality of sounder devices is configured to use its internal clock in conjunction with the one or more timing parameters unique to the corresponding sounder device to determine when to emit its audible alarm.

4. The method of claim 3, further comprising repeatedly sending the broadcast synchronization message to maintain the internal clocks of the plurality of sounder devices synchronized to within 1 millisecond.

5. The method of claim 1, wherein the one or more timing parameters are configured to cause each of the plurality of sounder devices to emit an audible alarm in a corresponding one of a plurality of sequential time slots of an alarm sequence, with a quiet period between each of the audible alarms.

6. The method of claim 5, wherein the quiet period is 5 milliseconds or less.

7. The method of claim 5, wherein the one or more timing parameters specify a corresponding one of the plurality of sequential time slots of the alarm sequence for the corresponding sounder device.

8. The method of claim 5, wherein the alarm sequence includes one or more time slots where all of the plurality of sounder devices emit an audible alarm, followed by a plurality of time slots where each of the plurality of sounder devices emit an audible alarm in a designated one of time slots.

9. The method of claim 1, further comprising:

repeatedly polling each of the plurality of sounder devices to verify that each of the plurality of sounder devices remains active.

10. The method of claim 1, further comprising:

determining a defined route toward the exit of the facility; and wherein the plurality of messages are configured to identify which of the plurality of sounder devices are to emit an audible alarm as part of an alarm sequence and when an audible alarm is to be emitted by each of the plurality of sounder devices to produce the perceivable sequential audible sweep along the defined route toward the exit of the facility.

11. The method of claim 1, wherein the one or more timing parameters comprise one or more of:

a trigger interval that specifies how long after the time of reception of the broadcast alarm message that the audible alarm of the corresponding sounder device is to be emitted; and an alarm duration that specifies a duration of the corresponding audible alarm.

12. A method for providing an indication of an exit route, the exit route including a plurality of devices networked to an alarm panel, each of the plurality of devices including an internal clock and being configured to provide an audible alarm, the method comprising:

the alarm panel sending to each of the plurality of devices that are networked to the alarm panel a specific position within an alarm sequence that specifies an order in which the plurality of devices are to each output their audible alarm;

the alarm panel broadcasting to each of the plurality of devices that are networked to the alarm panel an alarm signal; and in response to receiving the alarm signal from the alarm panel, each of the plurality of devices emitting an audible alarm in accordance with their specific position within the alarm sequence that specifies the order in which the plurality of devices are to each output their audible alarm.

13. The method of claim 12, further comprising in response to receiving the alarm signal from the alarm panel, each of the plurality of devices synchronizing their internal clocks.

14. The method of claim 12, wherein the alarm panel broadcasting a separate synchronization signal, and in response to the synchronization signal, each of the plurality of devices synchronizing their internal clocks.

15. The method of claim 12, wherein the plurality of devices each output their audible alarm such that a quiet period is provided between the specific position within the alarm sequence.

16. The method of claim 15, wherein the quiet period is 3 milliseconds or less.

17. A system comprising:

a plurality of sounder devices for emitting an audible alarm, each of the plurality of sounder devices having an internal clock;

an alarm panel operatively coupled to the plurality of sounder devices, the alarm panel configured to:

send to each of the plurality of sounder devices a specific position within an alarm sequence that specifies an order in which the plurality of sounder devices are to each output their audible alarm;

broadcast to each of the plurality of sounder devices an alarm signal; and in response to receiving the alarm signal, each of the plurality of sounder devices emitting an audible alarm in accordance with their specific position within the alarm sequence.

18. The system of claim 17, wherein the alarm panel is configured to broadcast to each of the plurality of sounder devices a synchronization signal, wherein in response to receiving the synchronization signal, each of the plurality of sounder devices synchronizing their internal clocks.

19. The system of claim 18, wherein the alarm panel is configured to repeatedly poll each of the plurality of sounder devices to verify that each of the plurality of sounder devices remains active.

20. The system of claim 17, wherein the plurality of sounder devices each output their audible alarm such that a quiet period is provided between the specific position within the alarm sequence, wherein the quiet period is 3 milliseconds or less.

* * * * *